US012408765B1

(12) United States Patent
Brees

(10) Patent No.: US 12,408,765 B1
(45) Date of Patent: Sep. 9, 2025

(54) BABY SLING

(71) Applicant: Diana L. Brees, Clarksville, TN (US)

(72) Inventor: Diana L. Brees, Clarksville, TN (US)

( * ) Notice: Subject to any disclaimer, the term of this patent is extended or adjusted under 35 U.S.C. 154(b) by 231 days.

(21) Appl. No.: 18/211,639

(22) Filed: Jun. 20, 2023

Related U.S. Application Data

(60) Provisional application No. 63/354,397, filed on Jun. 22, 2022.

(51) Int. Cl.
*A47D 13/02* (2006.01)

(52) U.S. Cl.
CPC ..... *A47D 13/025* (2013.01)

(58) Field of Classification Search
CPC ..... A47D 13/02; A47D 13/025
See application file for complete search history.

(56) References Cited

U.S. PATENT DOCUMENTS 4,757,925 A * 7/1988 Knittel ..... A47D 13/02 224/158
5,950,887 A 9/1999 Powell
D630,838 S * 1/2011 Gmeiner ..... D3/214
12,102,239 B2 * 10/2024 Dodge ..... A41D 1/21
2006/0237493 A1 * 10/2006 Tsai ..... A47D 13/025 224/159
2015/0189997 A1 7/2015 Gmeiner
2023/0101744 A1 * 3/2023 Dodge ..... A47D 13/02 224/159

FOREIGN PATENT DOCUMENTS

JP 3116735 U 12/2005
JP 2007105259 A 4/2007
JP 3132525 U 6/2007
JP 4809041 B2 11/2011
KR 200345181 Y1 3/2001
KR 20070065321 A 6/2007

OTHER PUBLICATIONS

Baby Boomba "How to Make a Baby Sling", https://babyboomba.com/make-a-baby-sling/ download, 19 pp.

* cited by examiner

*Primary Examiner* — Justin M Larson
(74) *Attorney, Agent, or Firm* — Shane Cortesi

(57) ABSTRACT

A baby sling is described. The baby sling may include a plurality of rings that are secured to one or more sling bodies. At least one of the sling bodies may include an upper portion, a seam, and left and right panels folded in an accordion-like manner. Methods of using a baby sling are also described.

20 Claims, 13 Drawing Sheets

BABY SLING

BACKGROUND

Technical Field

The present invention relates to baby slings.

Background of the Invention

Baby slings are a convenient, cost-effective way to hold infants and other children.

U.S. Design Pat. No. D630,838 illustrates an example of a baby sling.

Other baby slings are depicted in, for example, Japanese Patent 3132525, which shows a baby sling with angled tails, as well as Korean Patent 10-1167951.

However, many existing baby slings are uncomfortable to wear, due to the design and shape of the sling, as well as the lack of padding. In addition, novices often have difficulty using baby slings, which leads to frustration and lack of use. In addition, there is a need for providing extra support Thus, there is a continuing need for baby slings that are comfortable to wear, easy to use and readily bear the weight of the infant or other child.

SUMMARY OF THE INVENTION

The present disclosure provides a baby sling and methods of using same as described herein.

BRIEF DESCRIPTION OF THE DRAWINGS

in FIG. 22, the fastener is engaged (buttoned) so that the second sling body loop captures one of the plurality of rings, and in FIG. 23, the fastener is undone/disengaged so that the second sling body loop is opened to allow the second sling body to disengage from the ring (and the first sling body).

DETAILED DESCRIPTION

Figure 1:
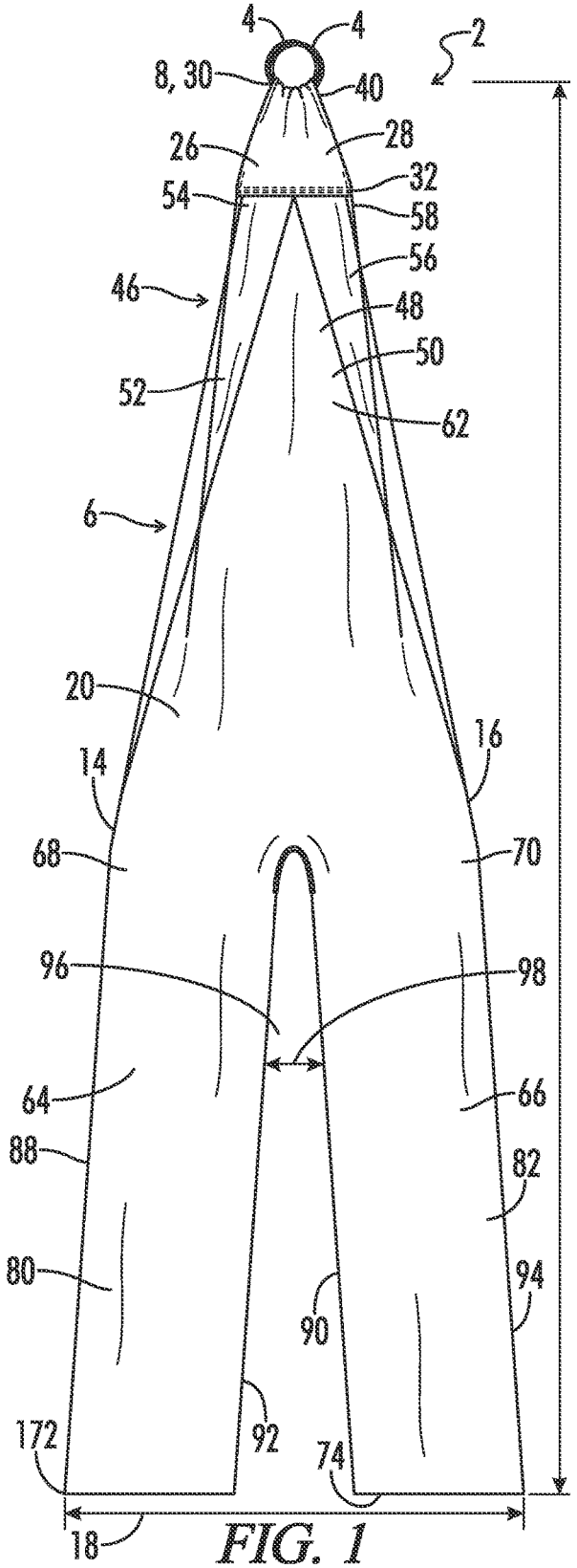
FIG. 1 illustrates a front elevation view of a baby sling in accordance with one embodiment of the present invention.

With reference to FIGS. 1-23, the present invention provides a baby sling 2. In the drawings, not all reference numbers are included in each of the drawings for the sake of clarity. FIGS. 1-23 are drawn generally to scale. However, it will be appreciated that other dimensions are possible. It will also be understood that all dimensions are exemplary.

Referring further to FIGS. 1-23, in some embodiments, the baby sling 2 includes at least one, but preferably, a plurality of, rings 4 and at least one sling body 6 attached to the ring(s) 4. The at least one sling body 6 may include a body top 8, a body bottom 10, a body height 12 extending from the body top 8 to the body bottom 10, a body left side 14, a body right side 16, a body width 18 extending from the body left side 14 to the body right side 16 and generally perpendicular to the body height 12, a body front side 20, a body rear side 22, and a body thickness 24 extending from the body front side 20 to the body rear side 22 and generally perpendicular to the body height 12 and body width 18. For purposes of the present invention, the sling body top 8 refers to the portion of the sling body closest to the ring 4. Similarly, the words "bottom" and "upper" (and the like) refer to the proximity to the ring(s) 4 as opposed to the orientation of the sling 2.

Preferably, the ring(s) 4 are generally circular in shape and at least one of the sling bodies 6 is slideable around the circumference of at least one ring 4.

At least one of the sling bodies 6 may also include a top portion 26 comprising a top portion front panel 28 comprising a top portion front panel top 30 and a top portion front panel bottom 32, and a top portion rear panel 34 comprising a top portion rear panel top 36 and a top portion rear panel bottom 38, the top portion front panel top 30 connected to the top portion rear panel top 36 and the top portion front panel bottom 32 connected to the top portion rear panel bottom 38 to form a loop 40, the loop 40 capturing the rings 4. The loop 40 is best seen in FIG. 13.

At least one of the sling bodies 6 may also include a seam 42 extending across the body width 18 and located adjacent the top portion front panel bottom 32 and top portion rear panel bottom 38, the seam 42 connecting the top portion front panel bottom 32 to the top portion rear panel bottom 38.

Figure 10:
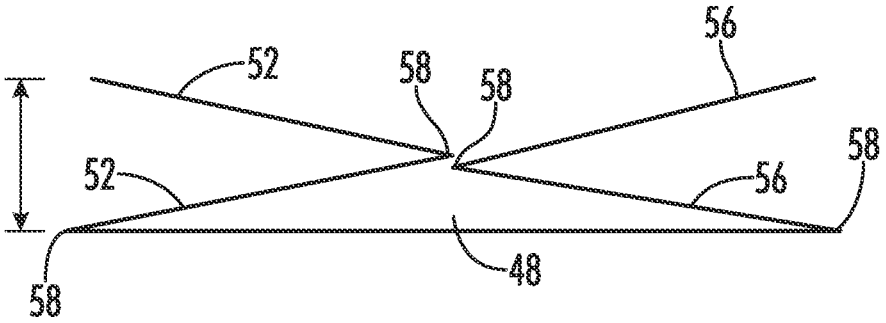
FIG. 10 illustrates an end view of a plurality of left panels folded along alternating fold lines, and a plurality of right panels folded along alternating fold lines of an upper portion of a baby sling in accordance with an embodiment of the present invention.
Figure 11:
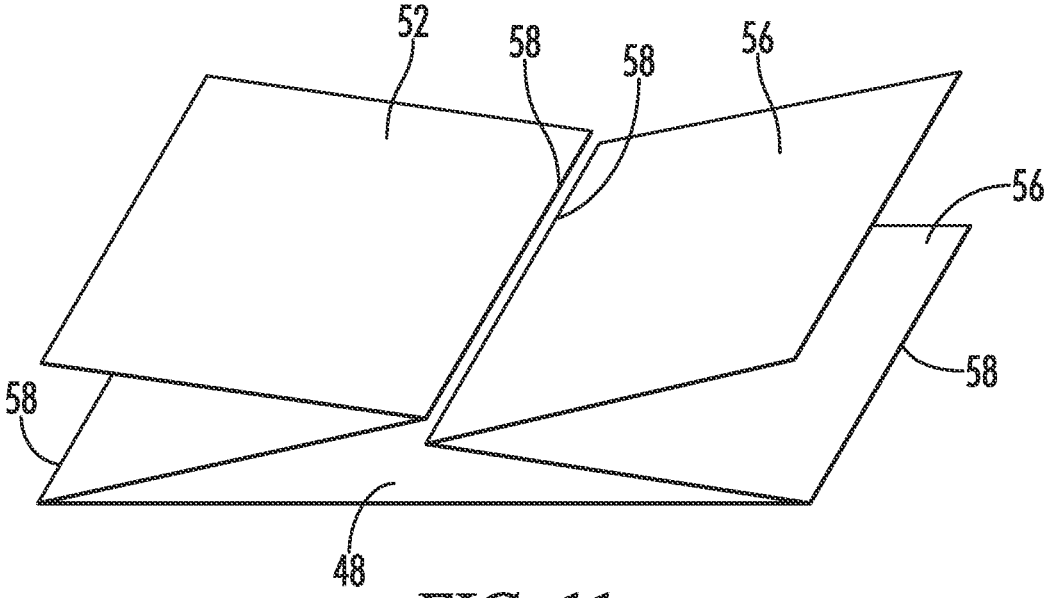
FIG. 11 illustrates a top, perspective view of the plurality of left panels and the plurality of right panels of FIG. 10.
Figure 12:
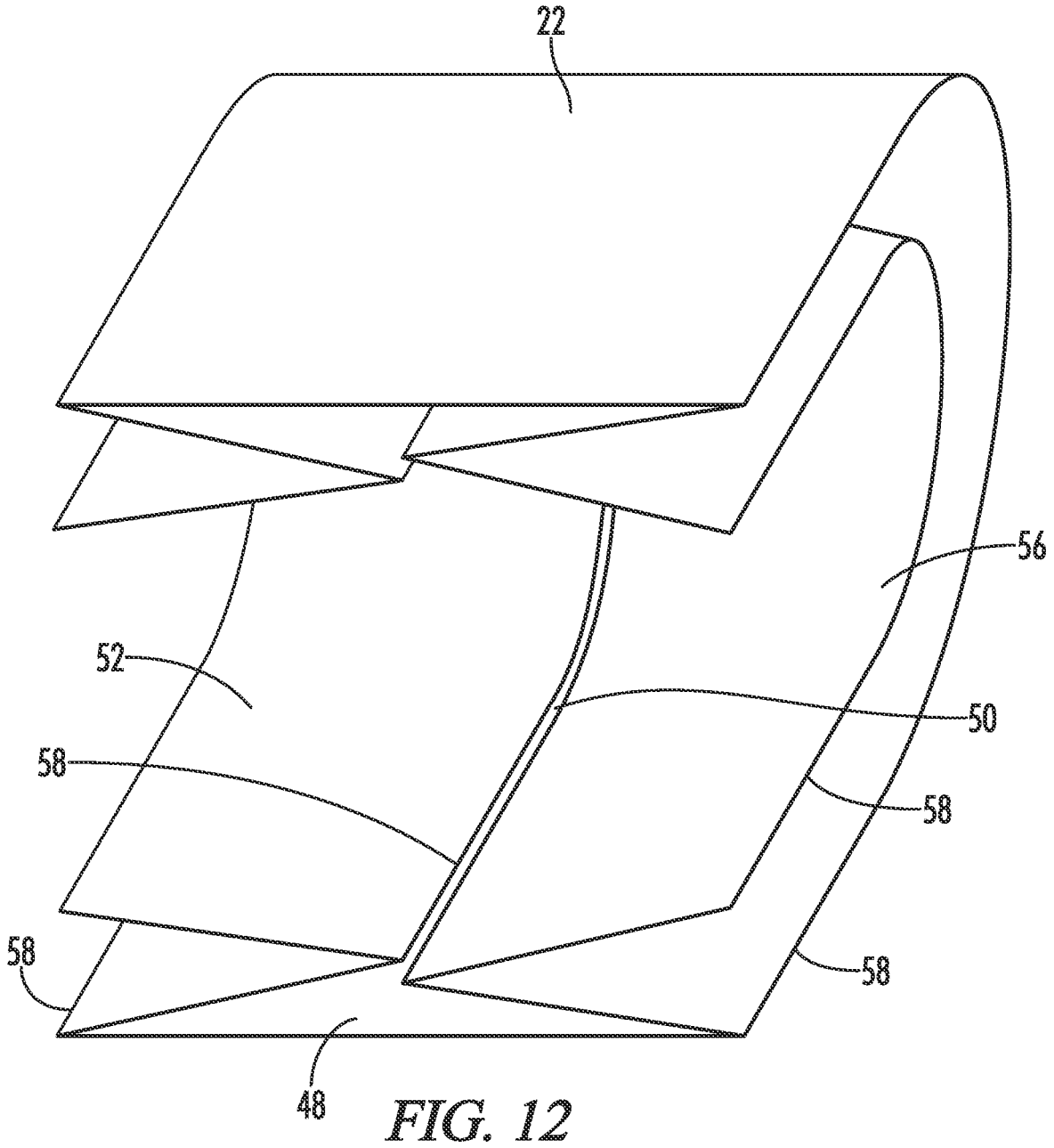
FIG. 12 illustrates another top, perspective view of the plurality of left panels and the plurality of right panels of FIG. 10 with the plurality of left and right panels being folded to form the sling's shoulder.

At least one of the sling bodies 6 (and preferably both if the sling 2 includes two sling bodies 6) may also include an upper portion 46 located below the seam 42 and comprising an upper portion rear panel 48, an open front 50 opposite the upper portion rear panel 48, a plurality of left panels 52 folded along alternating fold lines 60, and a plurality of right panels 56 folded along alternating fold lines 60. The plurality of left panels 52 may be separated from the plurality of right panels 56 by the open front 50. The upper portion rear panel 48, the open front 50, and the left and right panels 52,56 may define a cavity 62. The plurality of left and right panels 52,56 are best seen in FIGS. 10-12 where the panels are folded in an accordion-like manner.

Figure 13:
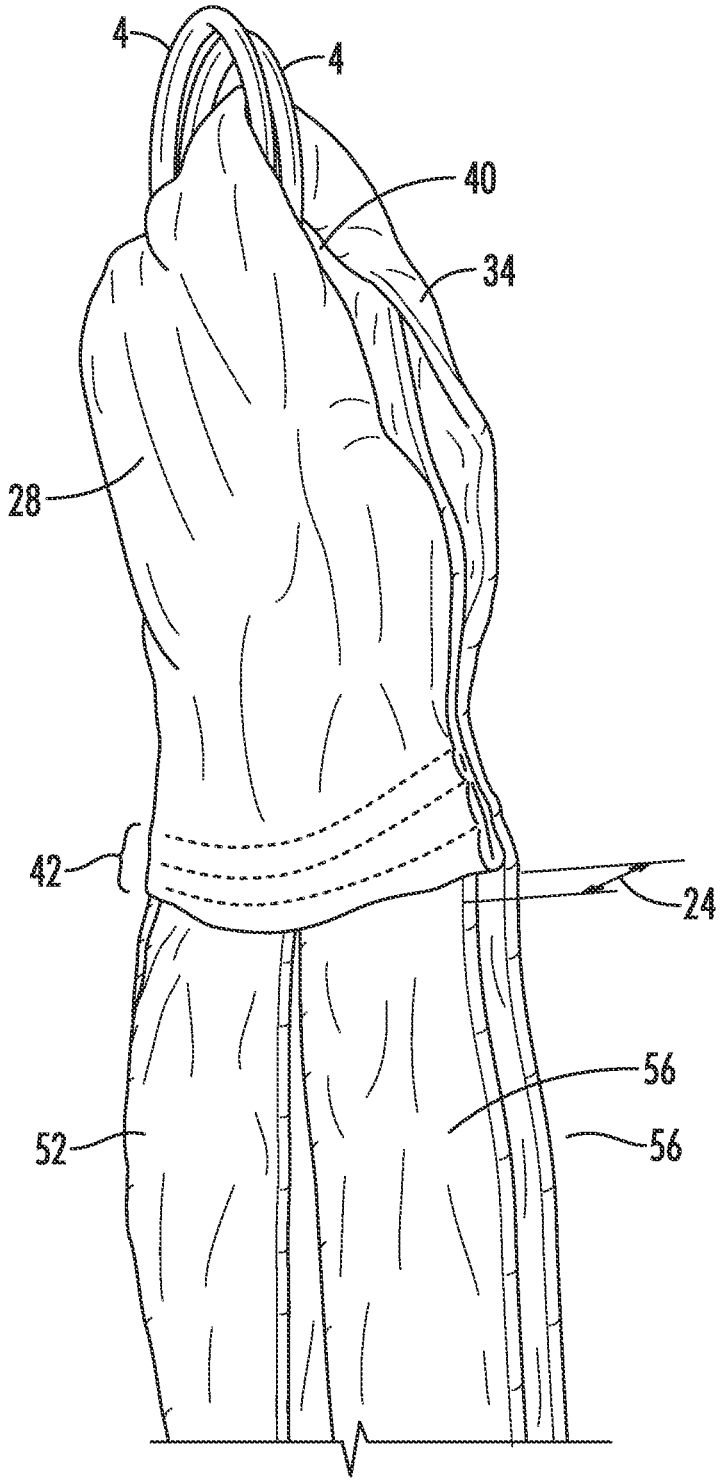
FIG. 13 illustrates a front perspective view of the top portion of the baby sling of FIG. 1.
Figure 14:
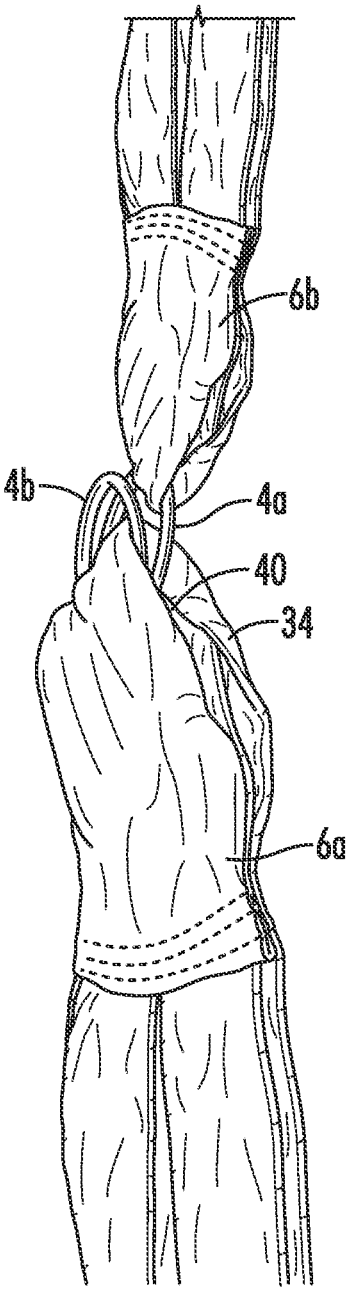
FIG. 14 illustrates a front perspective view of a baby sling in accordance with another embodiment of the present invention.
Figure 15:
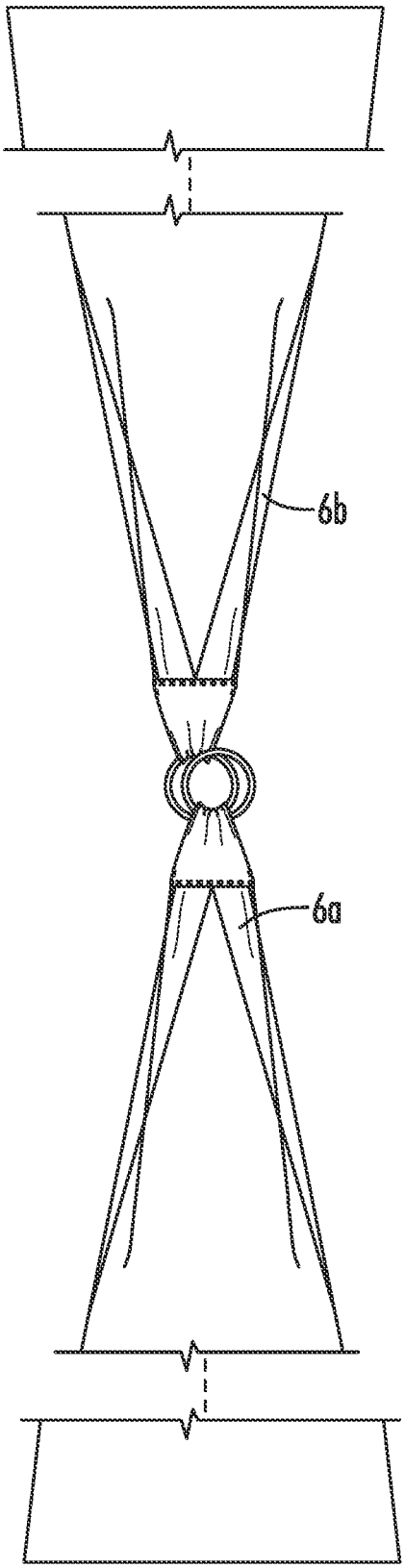
FIG. 15 illustrates a front elevation view of the baby sling of FIG. 14.

As best seen in FIG. 13, the seam 42 may comprise a plurality of rows of stitches, preferably three row. The seam 42 may form the bottom of the loop 40. The plurality of left panels 52 and the plurality of right panels 56 may each comprise a top 54,58 attached to the seam 42. The sling body 6 may be comprised of fabric, e.g, silk or cloth. The sling body 6 may be comprised of, for example, a single piece of fabric.

Figure 2:
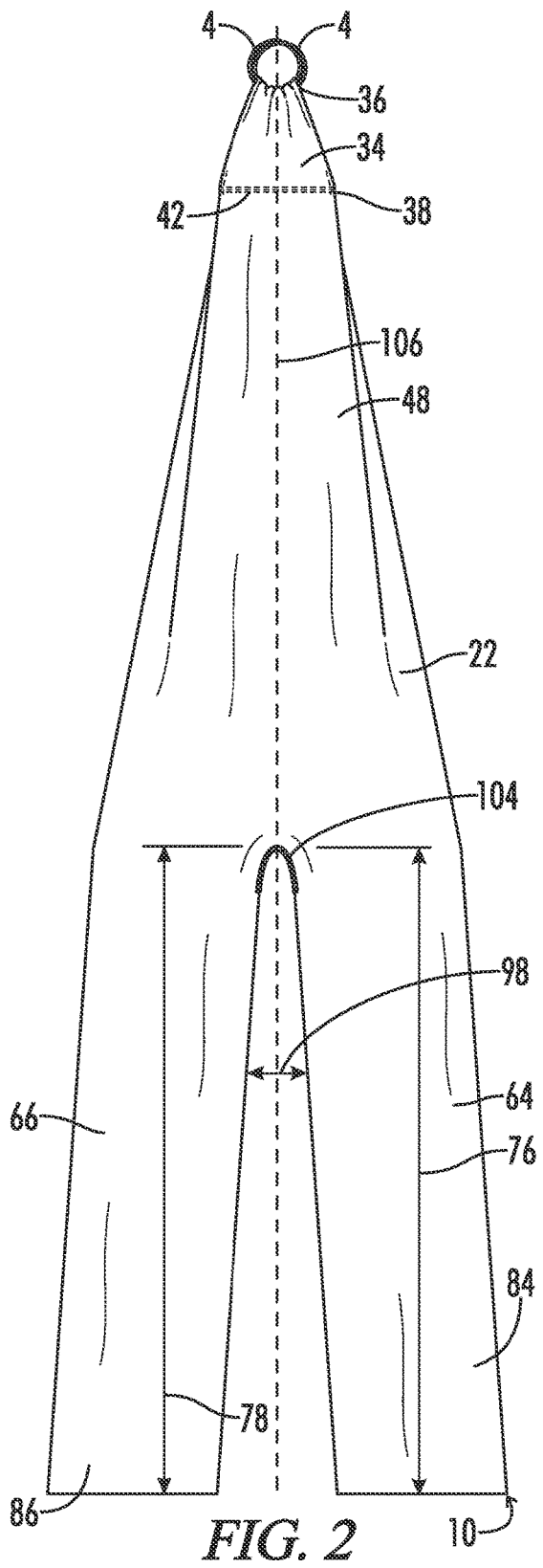
FIG. 2 illustrates a rear elevation view of the baby sling on FIG. 1.

The top portion 26 may be generally triangular in shape, as shown in FIGS. 1-2 for example. The top portion 26 may have a width of, for example, between about 9 inches and about 10 inches and the distance from the top of the rings 4, to the bottom of the seam 42 may be, for example, about 9 inches to encourage proper placement of the sling 2 on the wearer's shoulder. However, other dimensions are possible. The distance from the body top 8 to the bottom of the seam 42 may be, for example, between about 5.5 inches and about 7.5 inches (e.g., about 6.5 inches).

Figure 21:
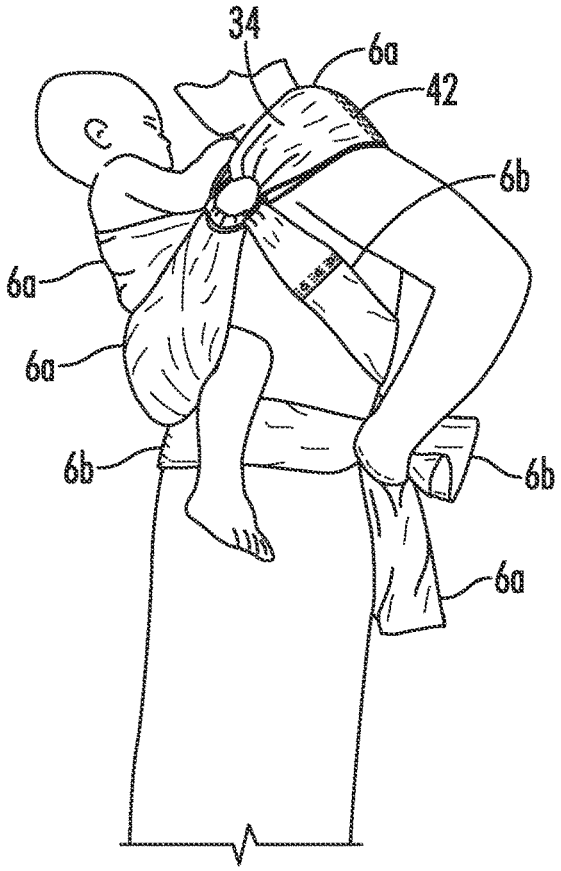
Figure 22:
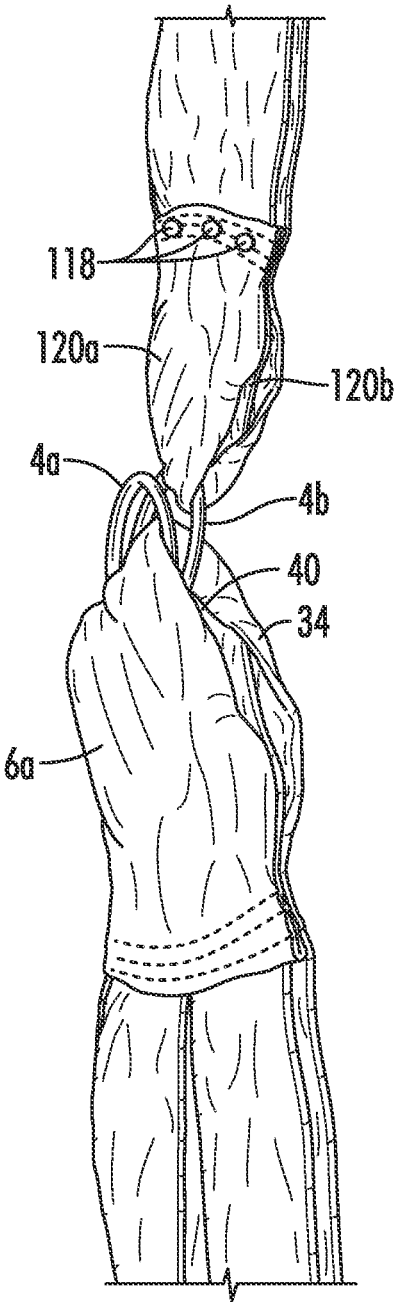
FIGS. 22-23 illustrate front perspective views of portions of a first sling body and portions of a second sling body of a baby sling of another embodiment of the invention.
Figure 23:
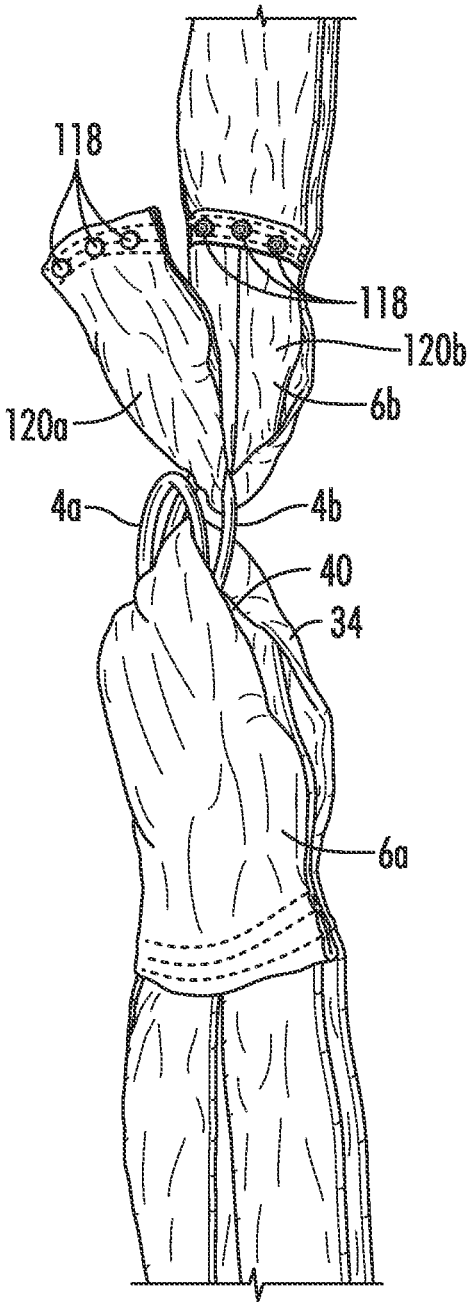

Preferably, as shown in FIGS. 14-23, the baby sling 2 includes two sling bodies 6*a* and 6*b*. As shown in FIGS. 14-23, optionally, the first sling body 6*a* is attached to both the front ring 4*a* and the rear ring 4*b* (has a loop 40 capturing both the front ring 4*a* and rear ring 4*b*) and optionally the first sling body 6*a* is slideable around the circumference of both the front ring 4*a* and the rear ring 4*b*. Further, as shown in FIGS. 14-23, optionally the second sling body 6*b* is attached to only rear ring 4*b* (has a loop 40 capturing only rear ring 4*b*) and optionally the second sling body 6*b* is slideable around the circumference of only rear ring 4*b*. As best seen in FIGS. 22-23, the second sling body 6*b* may include a fastener 118 (e.g., buttons or snaps) attaching one portion 120*a* of the second sling body 6 to another portion 120*b* of the second sling body 6*b* and releasably closing the loop 40. The fastener 118 may be located, for example, at the base of the loop 40. Optionally, the first sling body 6*a* is comprised of a single piece of fabric and the second sling body 6*b* is comprised of another single piece of fabric. Optionally, each sling body 6*a* and 6*b* includes a width 18 of at least ten inches and a height 12 of at least fifty inches for example. More particularly, optionally, the first sling body 6*a* comprises a width 18 of, for example, between about 22 inches and about 26 inches at the widest portion of the first sling body 6*a* and a height 12 of, for example, between about 95 inches and about 115 inches and the second sling body 6*b* comprises a width 18 of between about 10 and about 14 inches at the widest portion of the second sling body 6*b* and a height 12 of between about 70 and about 90 inches.

As shown in FIGS. 1-13, the sling body 6 may include a left tail 64 and a right tail 66. Each of the left tail 64 and the right tail 66 may include a top 68,70, a bottom 72,74 located at the body bottom 10, a height 76,78 extending from the top 68,70 to the bottom 72,74 and generally parallel to the body height 12, a front 80,82, a rear 84,86, a left side 88,90 and a right side 92,94. The left side of the right tail 90 may be separated from the right side of the left tail 92 by a gap 96.

The tail top may be below the cavity 62 and the plurality of left panels 52 and the plurality of right panels 56. The gap 96 may comprise a gap width 98 parallel to the body width 18, and the gap width 98 may increase from the top of the tails 68,70 to the bottom of the tails 72,74, as shown in FIGS. 1 and 2 for example. The baby sling 2 may further comprise a u-shaped reinforcement panel 104 extending along a portion of the left side of the right tail 90 and a portion of the right side of the left tail 92 to provide reinforcement as well as encourage separation of the tails 64,66.

The left tail bottom 72 and the right tail bottom 74 may be generally straight and parallel to the body width 18, as shown in FIGS. 1-2, for example. The left and right tails 64,66 may be generally rectangular in shape, as shown in FIGS. 1-2, for example. Optionally, depending on the fabric width and textile, the left tail may two inches to about three inches wider than the right tail. In addition, as shown in FIG. 2, the sling body 6 may be symmetrical about a longitudinal axis 106 extending downwardly from the plurality of rings 4 parallel to the body height 12.

Exemplary Methods of Use

The sling 2 may be used in any suitable manner.

Figure 16:
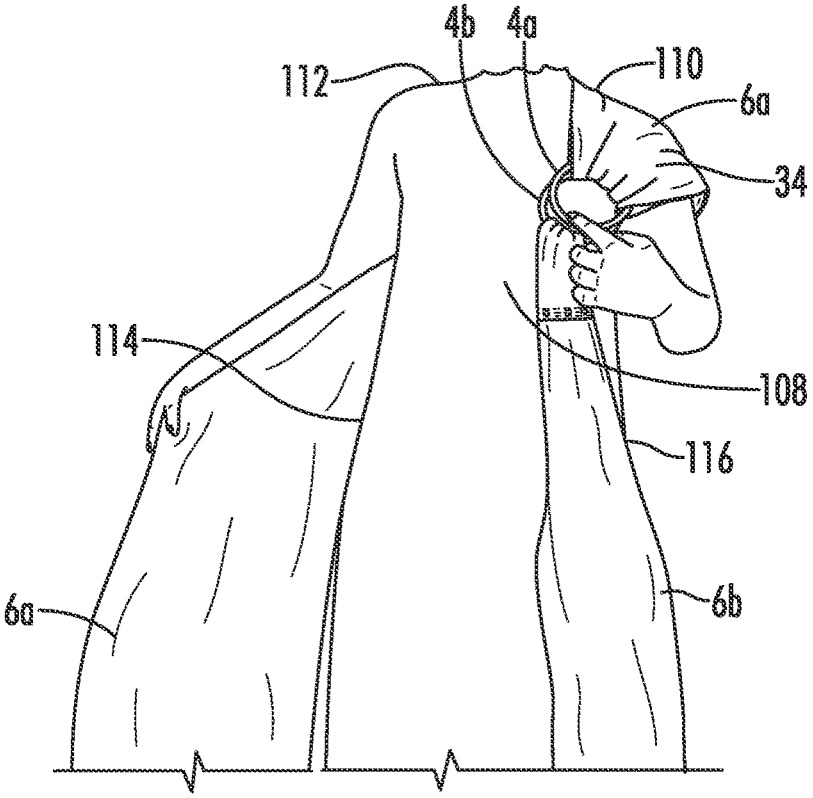
FIGS. 16-21 illustrate front perspective views of a wearer using the baby sling of FIG. 14.
Figure 17:
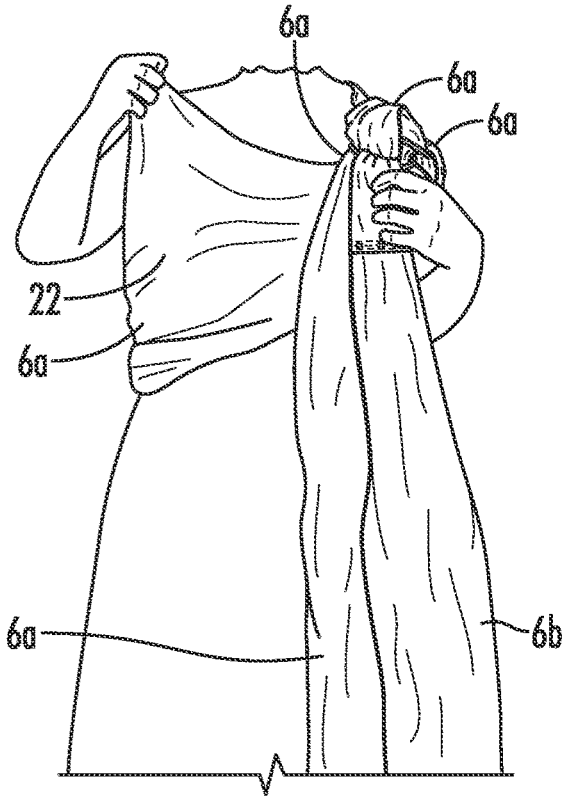
Figure 18:
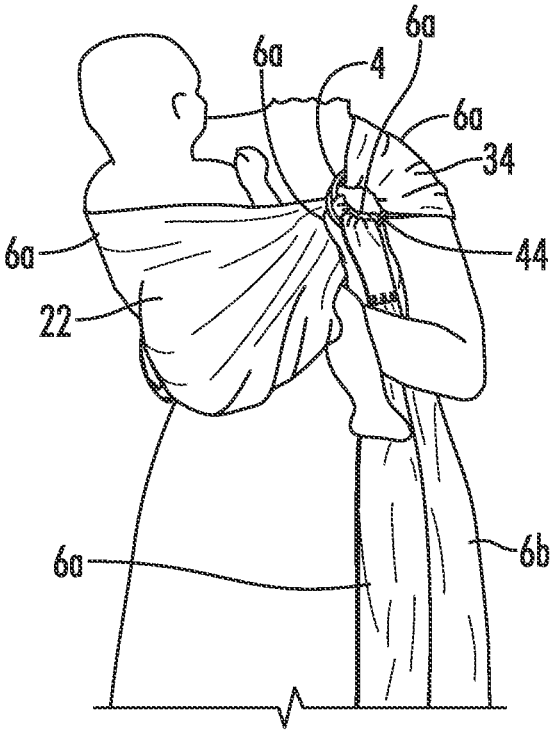
Figure 19:
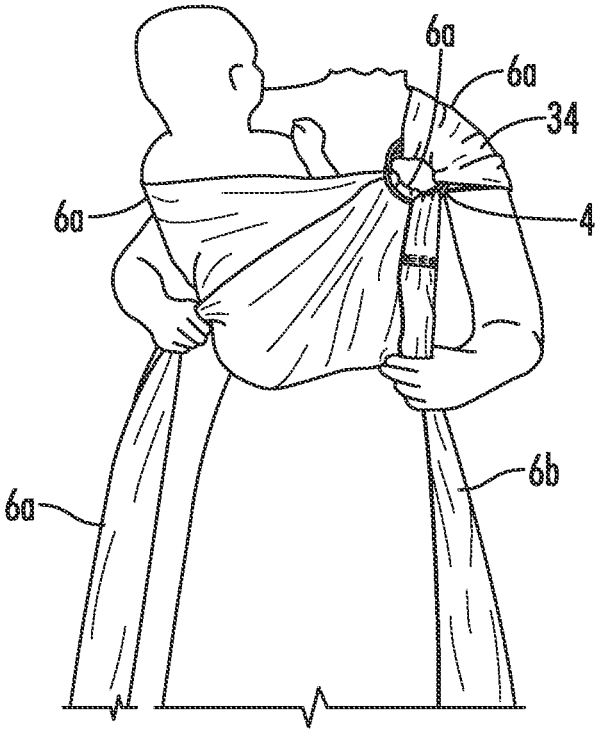
Figure 20:
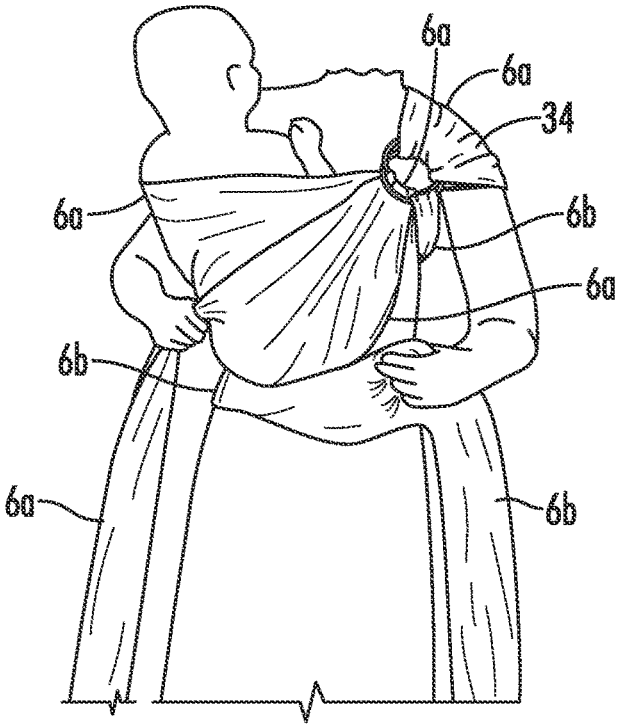

For example, in some embodiments, as shown in FIGS. 14-23, the sling 2 is used in a method that includes a) providing the baby sling 2; and b) as shown in FIG. 16, positioning the baby sling 2 on the wearer in a courage position of the wearer so that the plurality of rings 4*a* and 4*b* and the second sling body 6*b* are on the front of the wearer adjacent the chest 106 of the wearer, the first sling body 6*a* extends above the plurality of rings 4*a* and 4*b* and is located on the first shoulder 110 and back of the wearer. Optionally, the cavity 62 of the first sling body 6*a* is positioned against the back of the wearer. Optionally, the method further includes c) wrapping the first sling body 6*a* around a side of the wearer and over the wearer's chest 106. Optionally, the method further includes, as shown in FIG. 17, d) positioning the bottom 10 of the first sling body 6*a* rearwardly through the plurality of rings 4*a* and 4*b*. Optionally, as shown in FIGS. 17-18, the method further includes e) positioning the bottom 10 of the first sling body 6*a* over the front ring 4*a* then between the plurality of rings 4*a* and 4*b* and then through the rear ring 4*b* after step d). Optionally, the method further includes the step of f) pulling on the first sling body 6*a* to remove slack in the first sling body 6*a*. Optionally, the method further includes the step of g) positioning a child between a segment of the first sling body 6*a* and the second shoulder 112 so that the segment of the first sling body 6*a* holds the child against the wearer's chest 108. Optionally, the method further includes h) tying the first sling body 6*a* to the second sling body 6*b* behind the wearer's back, as shown in FIG. 21. Optionally, the method further includes the step of undoing the fastener 118 at any point in the process to release the first portion 120*a* of the second sling body 6*a* from the second portion 120*b* of the second sling body 6*b* and thereby open the second sling body loop 40 and allow the second sling body 6*b* to be removed from the rear ring 4*b* (i.e., the only ring to which the second sling body 6*b* is attached).

It will be understood that the uses described herein are exemplary and other uses are possible.

Figure 3:
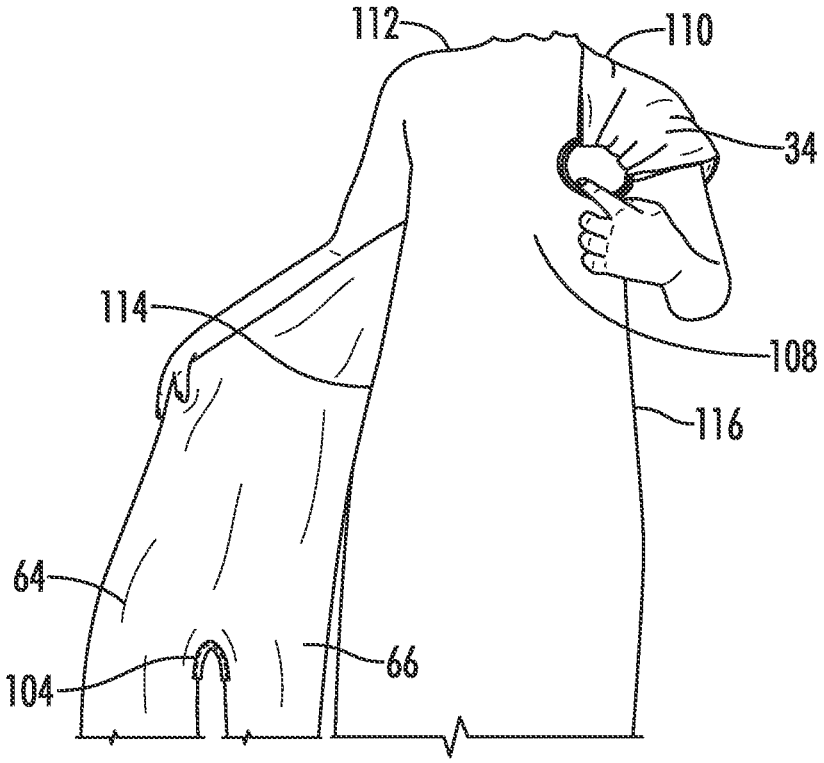
FIGS. 3-9 illustrate front perspective views of a wearer using the baby sling of FIG. 1.
Figure 4:
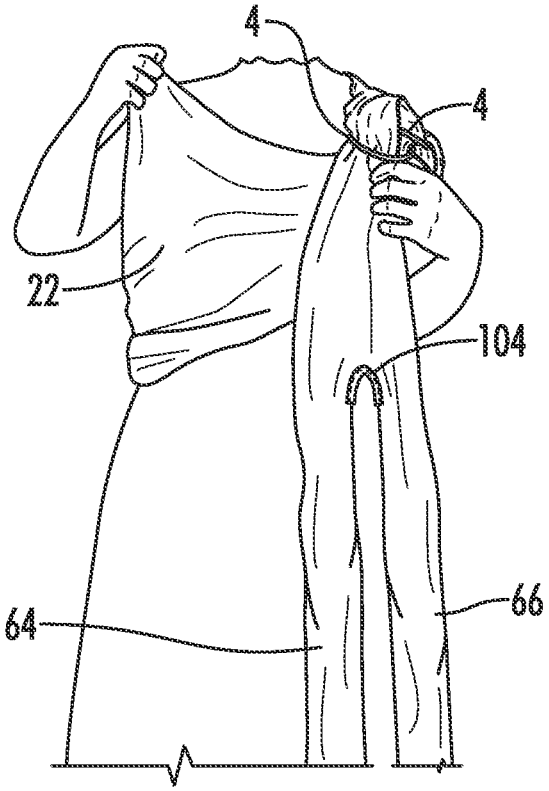
Figure 5:
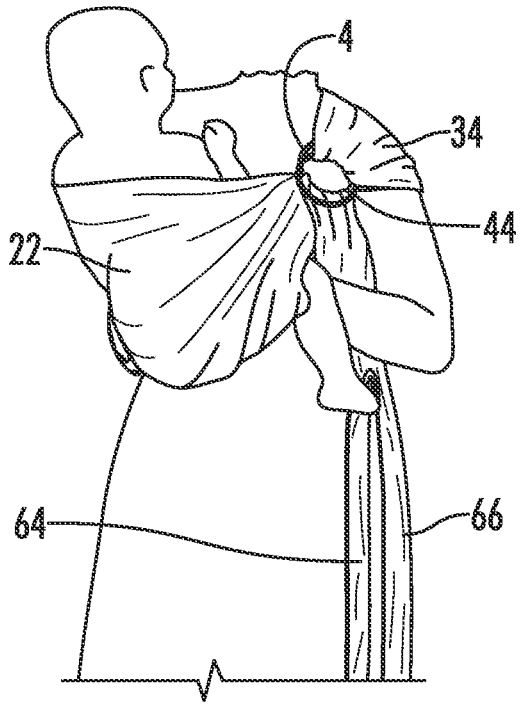
Figure 6:
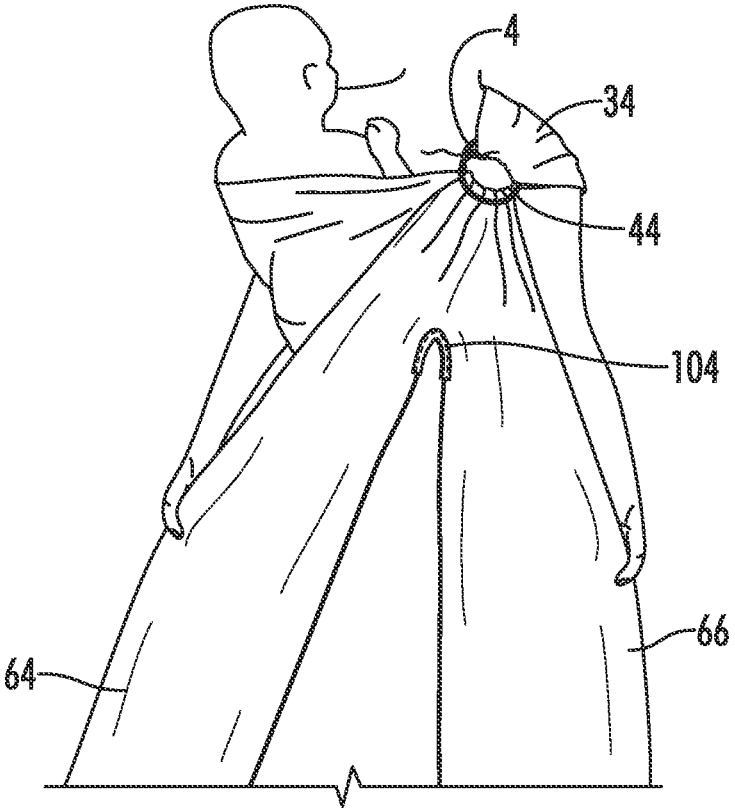
Figure 7:
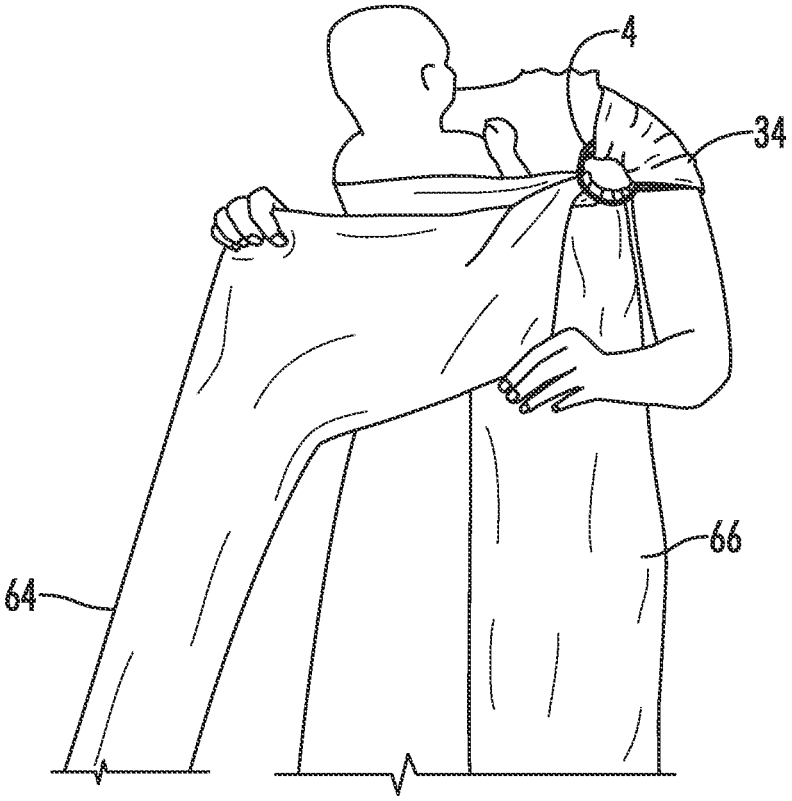
Figure 8:
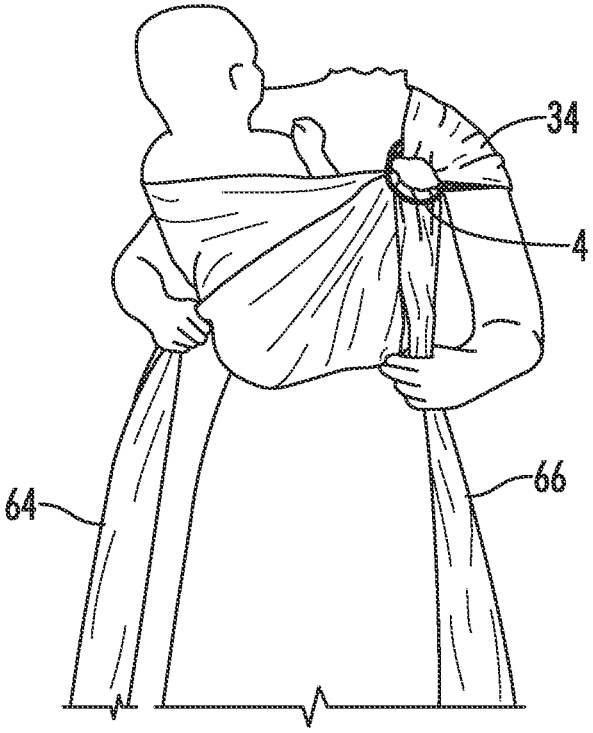
Figure 9:
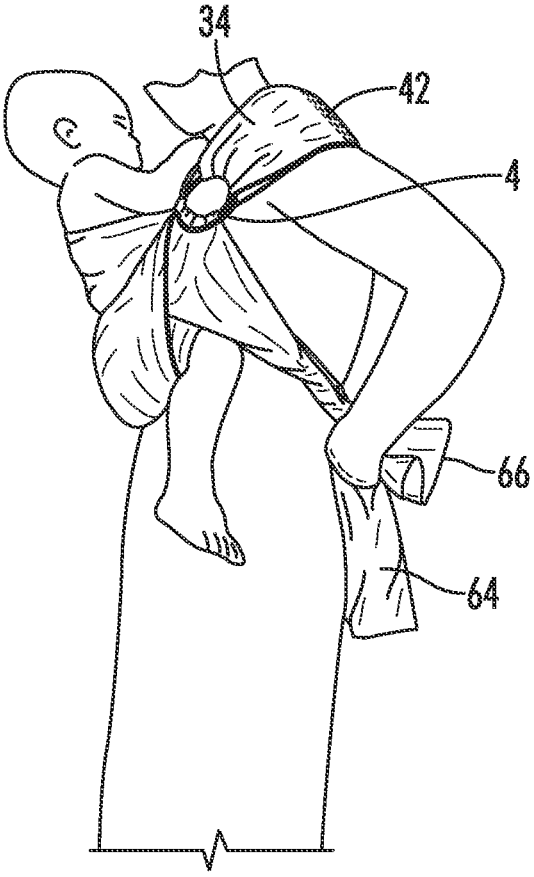

Optionally, as shown in FIGS. 1-13, the method includes a) providing the baby sling 2; b) positioning the plurality of rings 4 on the chest 108, in a corsage position of the wearer; and c) positioning a portion of the sling body 6 on the first shoulder 110 of the wearer, as shown in FIG. 3. As shown in FIG. 3, the method may also include d) positioning the cavity 62 against the back of the wearer. As shown in FIGS. 3-4, the method may also include the step of e) wrapping the sling body 6 around a side of the wearer 114, 116 (e.g., the side opposite the first shoulder 110) and over the wearer's chest 108. The method may also include step of f) positioning the left and right tails 64,66 through the plurality of rings 4, as shown in FIG. 4 to safely lock the fabric into place. The method may also include the step of g) moving a segment of the sling body 6 away from the wearer, and positioning a child between the segment of the sling body 6 and the second shoulder 112 so that the segment of the sling body 6 holds the child against the wearer's chest 108, as shown in FIGS. 4-5. The method may also include h) wrapping one of the left and right tails 64,66 around the segment of the sling body 6 holding the child, as shown in FIGS. 5-8. The method may also include i) tying the left tail 64 to the right tail 66 behind the back of the wearer, as shown in FIG. 9.

| Part List | |
|---|---|
| Baby Sling | 2 |
| Rings | 4 (or 4a for front ring and 4b for rearring) |
| Sling Body | 6 (or 6a for first sling body and 6b for second sling body) |
| Body Top | 8 |
| Body Bottom | 10 |
| Body Height | 12 |
| Body Left Side | 14 |
| Body Right Side | 16 |
| Body Width | 18 |
| Body Front Side | 20 |
| Body Rear Side | 22 |
| Body Thickness | 24 |
| Top Portion | 26 |
| Top Portion Front Panel | 28 |
| Top Portion Front Panel Top | 30 |
| Top Portion Front Panel Bottom | 32 |
| Top Portion Rear Panel | 34 |
| Top Portion Rear Panel Top | 36 |
| Top Portion Rear Panel Bottom | 38 |
| Loop | 40 |
| Seam | 42 |
| Upper Portion | 46 |
| Upper Portion Rear Panel | 48 |
| Open Front | 50 |
| Left Panels | 52 |
| Left Panels Top | 54 |
| Right Panels | 56 |
| Right Panels Top | 58 |
| Fold Lines | 60 |
| Cavity | 62 |
| Left Tail | 64 |
| Right Tail | 66 |
| Left Tail Top | 68 |
| Right Tail Top | 70 |
| Left Tail Bottom | 72 |
| Right Tail Bottom | 74 |
| Left Tail Height | 76 |
| Right Tail Height | 78 |
| Left Tail Front | 80 |
| Right Tail Front | 82 |
| Left Tail Rear | 84 |
| Right Tail Rear | 86 |
| Left Tail Left Side | 88 |
| Right Tail Left Side | 90 |
| Left Tail Right Side | 92 |
| Right Tail Right Side | 94 |
| Tail Gap | 96 |
| Tail Gap Width | 98 |
| U-Shaped Reinforcement Panel | 104 |
| Longitudinal Axis | 106 |
| Wearer Chest | 108 |
| Wearer First Shoulder | 110 |
| Wearer Second Shoulder | 112 |
| Wearer First Side | 114 |
| Wearer Second Side | 116 |
| Fastener | 118 |
| Portions of sling boyd | 120a and 120b |

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

What is claimed is:

1. A method of using a baby sling on a human wearer comprising a front comprising a chest, a back, a first shoulder, a second shoulder, two sides, and a back, the method comprising the steps of:

a) providing a baby sling comprising:

i) a plurality of rings, each ring comprising a circumference;

ii) a first sling body comprising a first sling body loop capturing all of the plurality of rings and slideable about the circumference of all of the plurality of rings; and iii) a second sling body opposite the first sling body and comprising a second sling body loop capturing one of the plurality of rings and slideable about the circumference of the one of the plurality of rings; and b) positioning the baby sling on the wearer so that the plurality of rings and the second sling body are on the front of the wearer adjacent the chest of the wearer, the first sling body extends above the plurality of rings and is located on the first shoulder and back of the wearer.

2. The method of claim 1 wherein the first sling and/or second sling body comprises a left tail and a right tail, each of the left tail and the right tail comprising a top, a bottom located at a bottom of the respective sling body, a height extending from the top to the bottom, a front, a rear, a left side and a right side, the left side the right tail separated from the right side of the left tail by a gap.

3. The method of claim 1 further comprising the step of c) positioning a child between a segment of the first sling body and the second shoulder so that the segment of the first sling body holds the child against the wearer's chest.

4. The method of claim 3 further comprising the step of d) tying the first sling body to the second sling body.

5. The method of claim 1 wherein the second sling body comprises a fastener attaching a first portion of the second sling body to a second portion of the second sling body and wherein the method further comprises, at any step in the process, undoing the fastener to release the first portion of the second sling body from the second portion of the second sling body and thereby open the second sling body loop and allow the second sling body to be removed from the one of the plurality of rings.

6. The method of claim 5 wherein the fastener is located at a base of the sling body loop.

7. The method of claim 1, wherein the first sling body comprises a first sling body seam forming a base of the first sling body loop and further wherein the second sling body comprises a second sling body seam forming a base of the second sling body loop and further wherein each sling body comprises a width of at least 10 inches and a height of at least 50 inches.

8. The method of claim 1, wherein the first sling body is comprised of a single piece of fabric and the second sling body is comprised of a single piece of fabric.

9. The method of claim 1, wherein the first sling body and/or second sling body comprises a generally triangular upper portion and a generally rectangular lower portion below the upper portion.

10. The method of claim 1, wherein the first sling body comprises a width of between about 22 and about 26 inches and a height of between about 95 inches and about 115 inches and the second sling body comprises a width of between about 10 inches and about 14 inches and a height of between about 70 and about 90 inches.

11. The method of claim 1, wherein the first sling body and/or second sling body comprises:

a body top, a body bottom, a body height extending from the body top to the body bottom, a body left side, a body right side, a body width extending from the body left side to the body right side and generally perpendicular to the body height, a body front side, a body rear side, and a body thickness extending from the body front side to the body rear side and generally perpendicular to the body height and body width;

a top portion comprising a top portion front panel comprising a top portion front panel top and a top portion front panel bottom, and a top portion rear panel comprising a top portion rear panel top and a top portion rear panel bottom, the top portion front panel top connected to the top portion rear panel top and the top portion front panel bottom connected to the top portion rear panel bottom to form said first and/or second sling body loop;

a seam extending across the body width and located adjacent the top portion front panel and top portion rear panel bottoms, the seam connecting the top portion front panel bottom to the top portion rear panel bottom; and an upper portion located below the seam and comprising an upper portion rear panel, an open front opposite the upper portion rear panel, a plurality of left panels folded along alternating fold lines, and a plurality of right panels folded along alternating fold lines, wherein the plurality of left panels is separated from the plurality of right panels by the open front, and further wherein the upper portion rear panel, the open front and the left and right panels define a cavity.

12. The method of claim 1 wherein at least the first sling body comprises:

a body top, a body bottom, a body height extending from the body top to the body bottom, a body left side, a body right side, a body width extending from the body left side to the body right side and generally perpendicular to the body height, a body front side, a body rear side, and a body thickness extending from the body front side to the body rear side and generally perpendicular to the body height and body width;

a top portion comprising a top portion front panel comprising a top portion front panel top and a top portion front panel bottom, and a top portion rear panel comprising a top portion rear panel top and a top portion rear panel bottom, the top portion front panel top connected to the top portion rear panel top and the top portion front panel bottom connected to the top portion rear panel bottom to form said first and/or second sling body loop;

a seam extending across the body width and located adjacent the top portion front panel and top portion rear panel bottoms, the seam connecting the top portion front panel bottom to the top portion rear panel bottom; and an upper portion located below the seam and comprising an upper portion rear panel, an open front opposite the upper portion rear panel, a plurality of left panels folded along alternating fold lines, and a plurality of right panels folded along alternating fold lines, wherein the plurality of left panels is separated from the plurality of right panels by the open front, and further wherein the upper portion rear panel, the open front and the left and right panels define a cavity, and the cavity is positioned against the back of the wearer in step b).

13. A baby sling comprising:

a plurality of rings, each ring comprising a circumference;

a first sling body comprising a first sling body loop capturing the plurality of rings and slideable about the circumference of the plurality of rings; and a second sling body opposite the first sling body and comprising a second sling body loop capturing one of the plurality of rings and slideable about the circumference of the one of the plurality of rings.

14. The baby sling of claim 13, wherein the first sling body comprises a first sling body seam forming a base of the first sling body loop and further wherein the second sling body comprises a second sling body seam forming a base of the second sling body loop and further wherein each sling body comprises a width of at least 10 inches and a height of at least 50 inches.

15. The baby sling of claim 13, wherein the first sling body is comprised of a single piece of fabric and the second sling body is comprised of a single piece of fabric.

16. A baby sling comprising:

a plurality of rings; and a first sling body attached to the plurality of rings, the first sling body comprising:

a body top, a body bottom, a body height extending from the body top to the body bottom, a body left side, a body right side, a body width extending from the body left side to the body right side and generally perpendicular to the body height, a body front side, a body rear side, and a body thickness extending from the body front side to the body rear side and generally perpendicular to the body height and body width;

a top portion comprising a top portion front panel comprising a top portion front panel top and a top portion front panel bottom, and a top portion rear panel comprising a top portion rear panel top and a top portion rear panel bottom, the top portion front panel top connected to the top portion rear panel top and the top portion front panel bottom connected to the top portion rear panel bottom to form a first sling body loop, the first sling body loop capturing the plurality of rings;

a seam extending across the body width and located adjacent the top portion front panel and top portion rear panel bottoms, the seam connecting the top portion front panel bottom to the top portion rear panel bottom;

an upper portion located below the seam and comprising an upper portion rear panel, an open front opposite the upper portion rear panel, a plurality of left panels folded along alternating fold lines, and a plurality of right panels folded along alternating fold lines, wherein the plurality of left panels is separated from the plurality of right panels by the open front, and further wherein the upper portion rear panel, the open front and the left and right panels define a cavity, the sling further comprising a second sling body opposite the first sling body and comprising a second sling body loop capturing one of the plurality of rings and slideable about a circumference of the one of the plurality of rings.

17. The baby sling of claim 16 wherein the first sling body comprises a left tail and a right tail, each of the left tail and the right tail comprising a top, a bottom located at the body bottom, a height extending from the top to the bottom and generally parallel to the body height, a front, a rear, a left side and a right side, the left side the right tail separated from the right side of the left tail by a gap.

18. The baby sling of claim 17 wherein the left tail bottom and the right tail bottom are generally straight and parallel to the body width.

19. A method of using a baby sling on a human wearer comprising a chest, a first shoulder, a second shoulder, two sides, and a back, the method comprising the steps of:

a) providing the baby sling of claim 17;

b) positioning the cavity against the back of the wearer; and c) wrapping the sling body around a side of the wearer and over the wearer's chest.

20. The method of claim 19 wherein the method further comprises d) positioning a child between a portion of the sling body and the second shoulder so that the sling portion holds the child against the wearer's chest.

* * * * *